US008757040B1

(12) United States Patent
Galloway et al.

(10) Patent No.: US 8,757,040 B1
(45) Date of Patent: Jun. 24, 2014

(54) GUN GRIPPING ASSISTING ASSEMBLY

(76) Inventors: Kevin S. Galloway, Salem, SC (US); David Johnson, Salem, SC (US)

( * ) Notice: Subject to any disclaimer, the term of this patent is extended or adjusted under 35 U.S.C. 154(b) by 78 days.

(21) Appl. No.: 13/484,570

(22) Filed: May 31, 2012

(51) Int. Cl.
*F41C 23/02* (2006.01)
*F41C 23/16* (2006.01)

(52) U.S. Cl.
CPC ..... *F41C 23/02* (2013.01); *F41C 23/16* (2013.01)
USPC ..... 89/1.42

(58) Field of Classification Search
CPC ..... F41C 23/02; F41C 23/16; F41C 33/08
USPC ..... 89/1.4, 1.42
See application file for complete search history.

(56) References Cited

U.S. PATENT DOCUMENTS 3,225,653 A * 12/1965 Packard ..... 89/1.4
3,927,808 A 12/1975 Steen
4,542,840 A 9/1985 Pepper, Sr. et al.
4,827,652 A * 5/1989 Martin ..... 42/142
5,018,652 A 5/1991 Holtzclaw, Jr.
5,642,584 A 7/1997 Riggenbach
6,112,448 A 9/2000 Gray et al.
6,178,600 B1 1/2001 French
D472,798 S 4/2003 Kalbach
7,243,454 B1 7/2007 Cahill
7,823,312 B2 11/2010 Faifer
8,028,457 B2 10/2011 Moody et al.
2010/0199541 A1 * 8/2010 Vest et al. ..... 42/85

* cited by examiner

*Primary Examiner* — Stephen M Johnson

(57) ABSTRACT

A gun gripping assisting assembly includes a panel that has a top side, a bottom side, a front edge, a rear edge, a first lateral edge and a second lateral edge. A coupler is attached to the panel and is attached to a gun stock. A grip is attached to and extends downwardly from the bottom side of the panel. The grip has a first end and a second end. The first end abuts the panel. The grip is arcuate from the first end to the second end such that the grip has an upper surface that is concavely arcuate and faces the bottom side and a lower surface that is convexly arcuate and faces away from the panel.

12 Claims, 5 Drawing Sheets

GUN GRIPPING ASSISTING ASSEMBLY

BACKGROUND OF THE DISCLOSURE

Field of the Disclosure

The disclosure relates to gun gripping devices and more particularly pertains to a new gun gripping device for assisting a person in gripping a rifle.

SUMMARY OF THE DISCLOSURE

An embodiment of the disclosure meets the needs presented above by generally comprising a panel that has a top side, a bottom side, a front edge, a rear edge, a first lateral edge and a second lateral edge. A coupler is attached to the panel and is configured to be attached to a gun stock. A grip is attached to and extends downwardly from the bottom side of the panel. The grip has a first end and a second end. The first end abuts the panel. The grip is arcuate from the first end to the second end such that the grip has an upper surface that is concavely arcuate and faces the bottom side and a lower surface that is convexly arcuate and faces away from the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
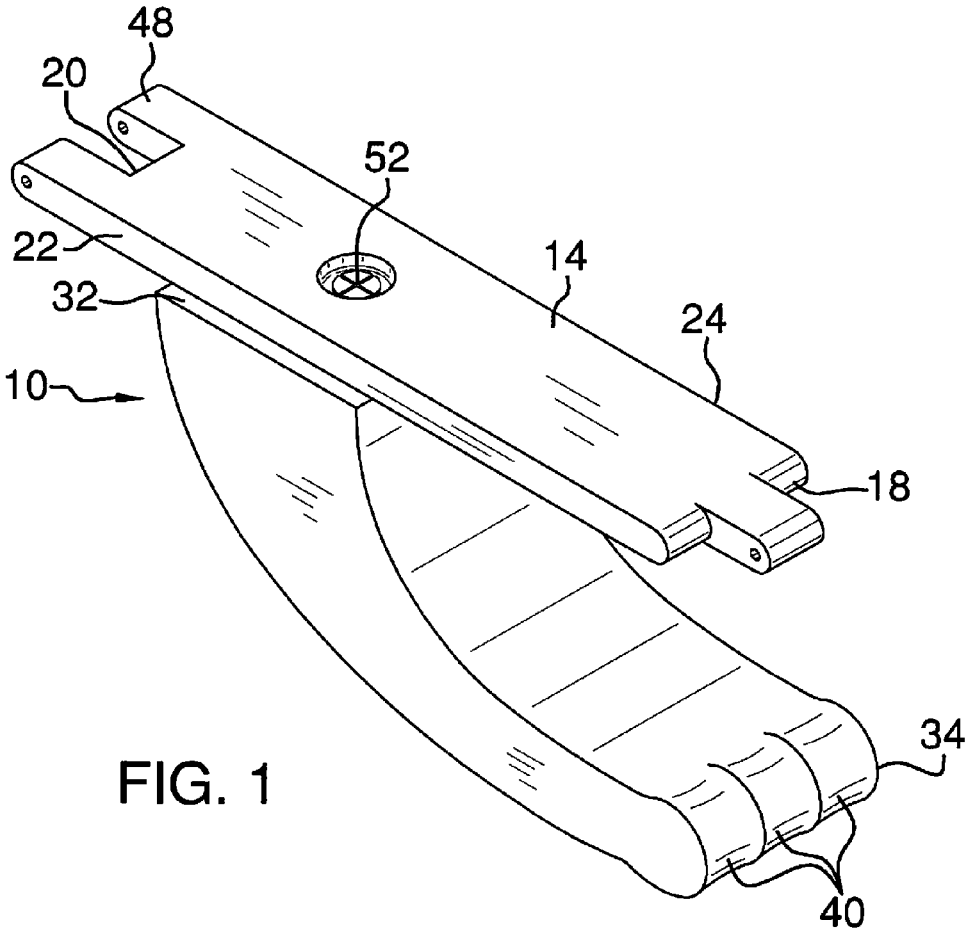
FIG. 1 is a top perspective view of a gun gripping assisting assembly according to an embodiment of the disclosure.
Figure 2:
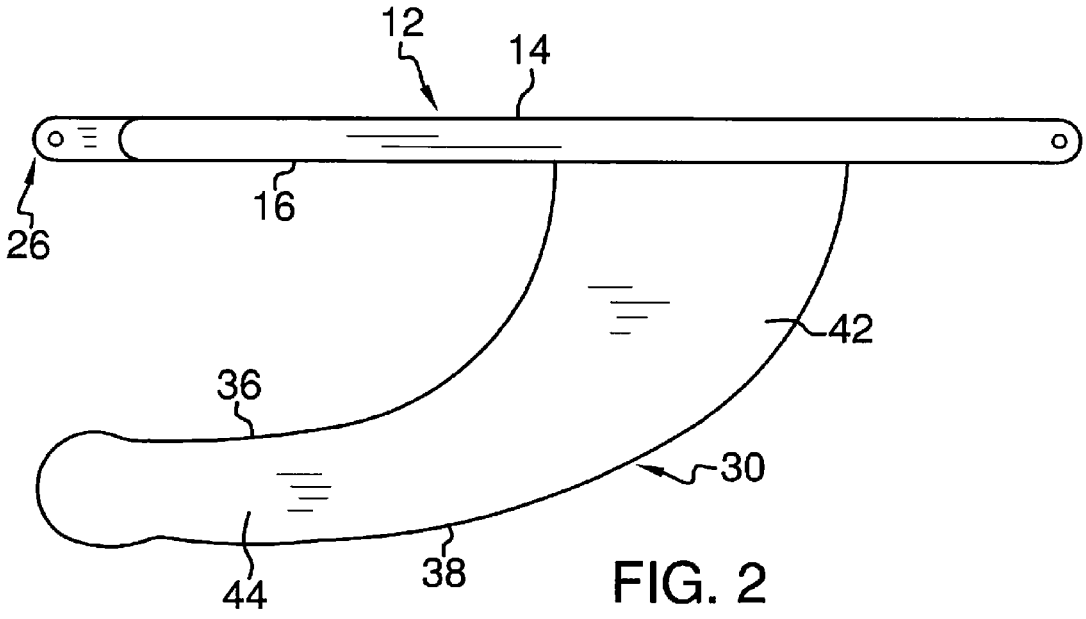
FIG. 2 is a side view of an embodiment of the disclosure.
Figure 3:
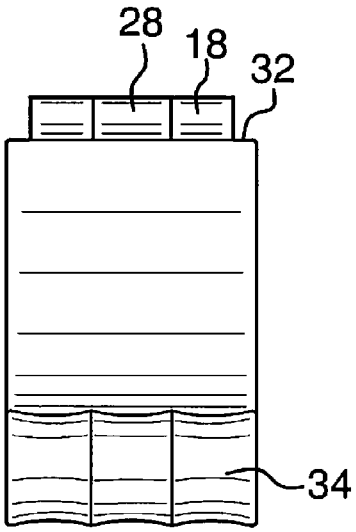
FIG. 3 is a front view of an embodiment of the disclosure.
Figure 4:
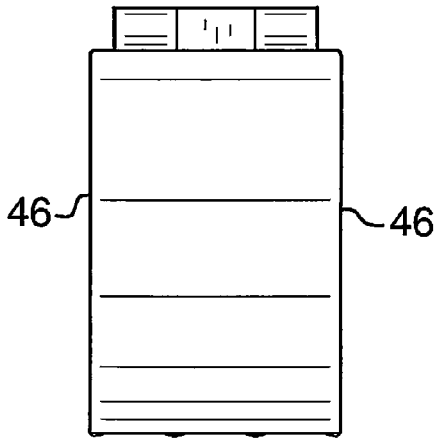
FIG. 4 is a rear view of an embodiment of the disclosure.
Figure 5:
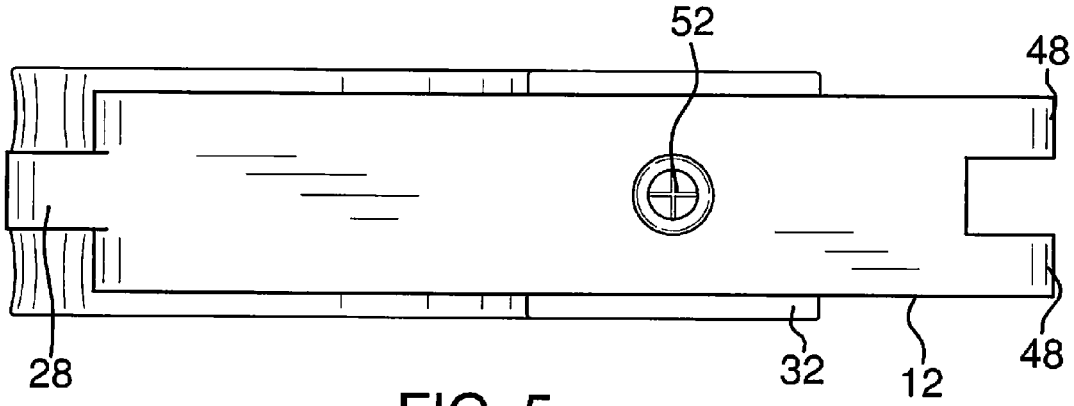
FIG. 5 is a top view of an embodiment of the disclosure.
Figure 6:
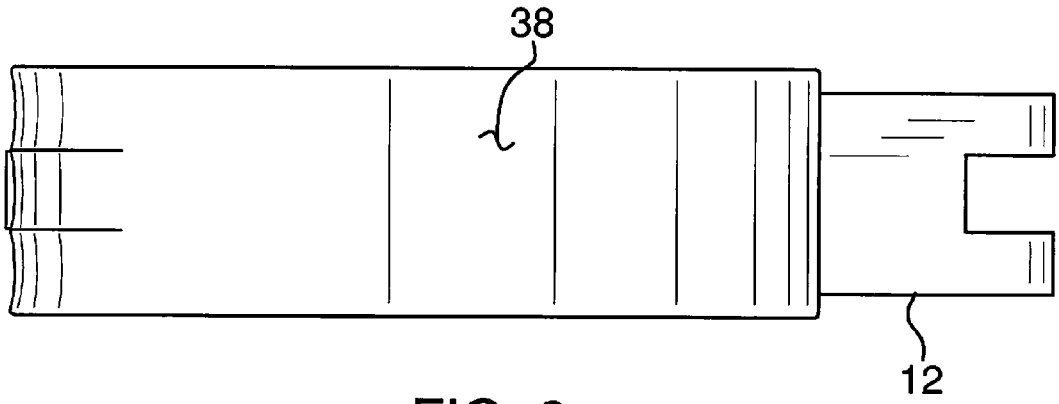
FIG. 6 is a bottom view of an embodiment of the disclosure.
Figure 7:
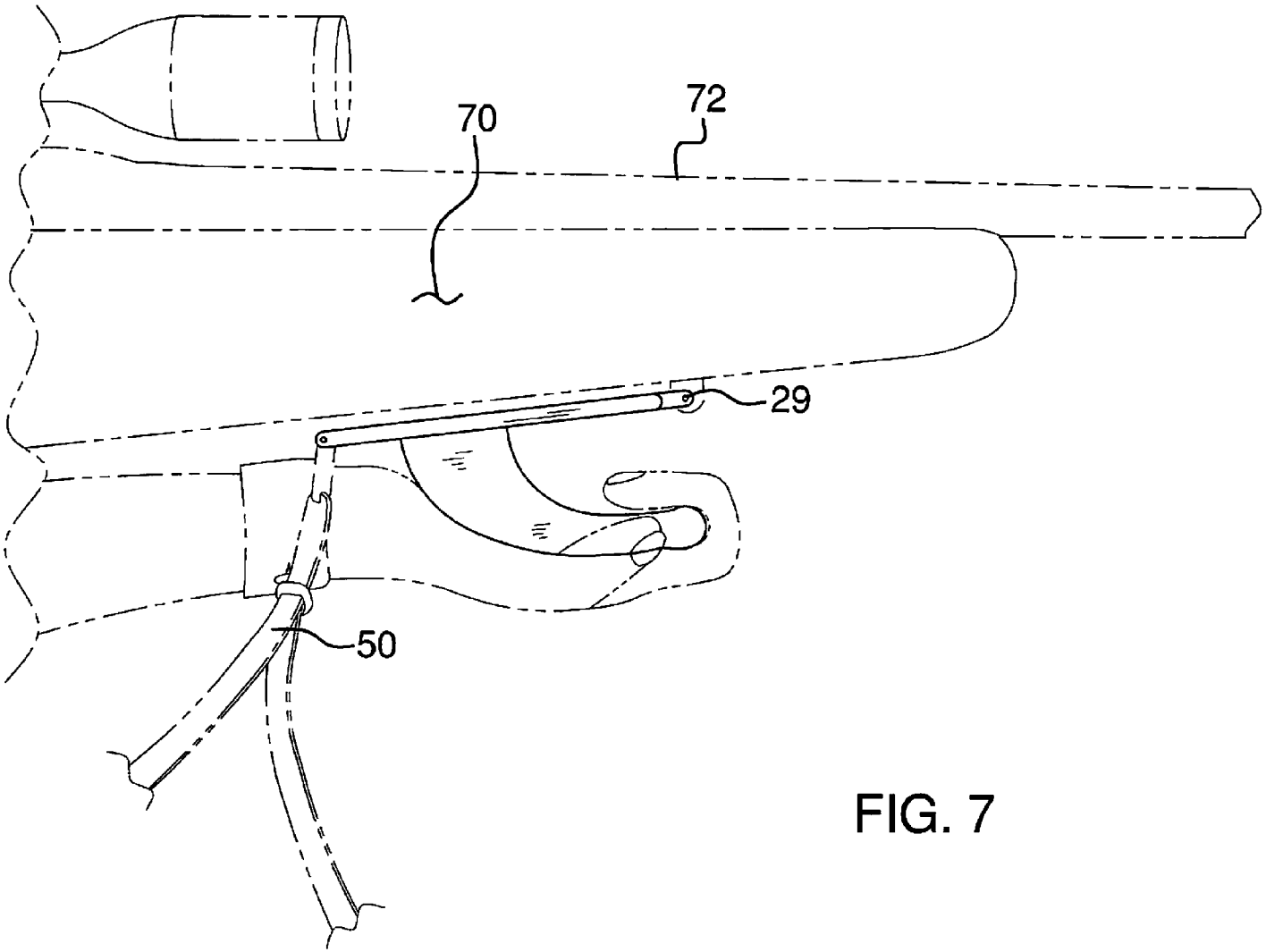
FIG. 7 is a side in-use view of an embodiment of the disclosure.
Figure 8:
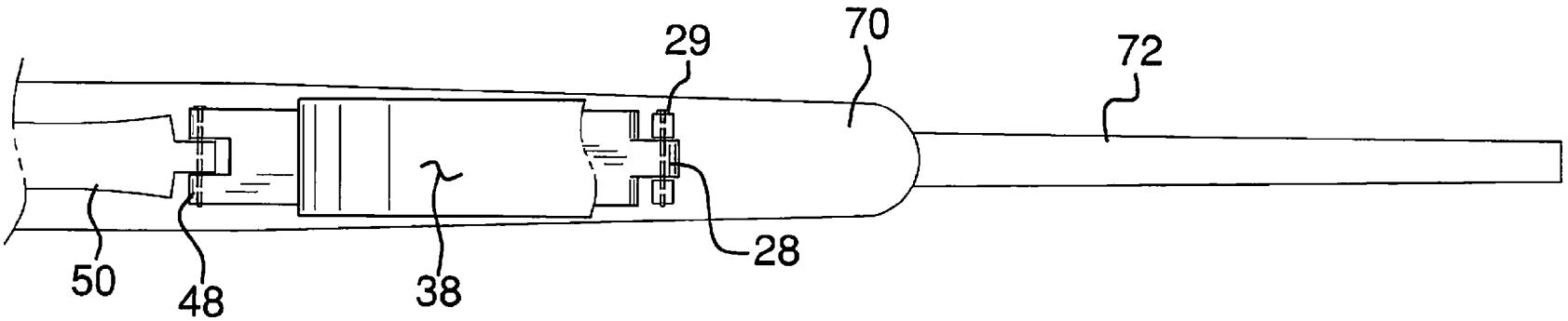
FIG. 8 is a bottom broken view of an embodiment of the disclosure.

With reference now to the drawings, and in particular to FIGS. 1 through 8 thereof, a new gun gripping device embodying the principles and concepts of an embodiment of the disclosure and generally designated by the reference numeral 10 will be described.

As best illustrated in FIGS. 1 through 8, the gun gripping assisting assembly 10 generally comprises a panel 12 that has a top side 14, a bottom side 16, a front edge 18, a rear edge 20, a first lateral edge 22 and a second lateral edge 24. A coupler 26 is attached to the panel 12 and attaches the panel 12 to a gun stock 70. The coupler 26 is attached to the front edge 18 of the panel 12 and may comprise a pivoting member configured to be pivotally coupled to the gun stock 70. More particularly, the coupler 26 may include a flange 28 extending outwardly from the front edge 18 which engages a pivot pin 29 attached to the gun stock 70.

A grip 30 is attached to and extends downwardly from the bottom side 16 of the panel 12. The grip 30 has a first end 32 and a second end 34 and the first end 32 abuts the panel 12. The grip 30 is arcuate from the first end 32 to the second end 34 so that the grip 30 has an upper surface 36 that concavely arcuate and faces the bottom side 16. A lower surface 38 of the grip 30 is convexly arcuate and faces away from the panel 12. The second end 34 is convexly arcuate from the lower surface 38 to the upper surface 36. The second end 34 has a plurality of indentations 40 therein extending from the lower surface 38 to the upper surface 36 for facilitating finger engagement with the grip 30. The grip 30 includes a vertical portion 42 extending downwardly from the panel 12 and a horizontal portion 44 extending generally horizontally away from the vertical portion 42. The vertical portion 42 extends less than 4.0 inches downwardly from the panel 12. The horizontal portion 44 extends at least 3.0 inches away from the vertical portion 42. The grip 30 may have a lateral dimension between lateral sides 46 between 2.0 inches and 4.0 inches.

An attachment member 48 is attached to the rear edge 20 and is configured for attachment to a shoulder strap 50 of a firearm 72. The panel 12 therefore is positioned between and couples the strap 50 to the gun stock 70. The grip 30 is rotatably coupled to the panel 12, such as with a pivot rod 52, to allow the second end 34 to be extended toward the front edge 18 in a deployed position or toward the rear edge 20 in a stored position. When the user carries the firearm 72 with the shoulder strap 50, the grip 30 is placed in the stored position so that the second end 34 does not abut and mar the gun stock 70.

In use, the user of the assembly 10 may grasp the grip for stability purposes while firing the firearm 72, which will typically comprise a rifle. If the user does not want to use the grip 30, or is simply carrying the firearm by the gun stock 70, the panel 12 may be pivoted away from the gun stock 70 to expose the gun stock 70. The grip provides for better balance and stability while aiming the firearm 72.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A gun gripping assembly configured for mounting on a gun stock, said assembly comprising:

a panel having a top side, a bottom side, a front edge, a rear edge, a first lateral edge and a second lateral edge, a coupler being attached to said panel, said coupler being configured to be attached to a gun stock; and a grip being attached to and extending downwardly from said bottom side of said panel, said grip having a first end and a second end, said first end abutting said panel, said grip being arcuate from said first end to said second end such that said grip has an upper surface being concavely arcuate and facing said bottom side and a lower surface being convexly arcuate and facing away from said panel, said second end has a plurality of indentations therein extending from said lower surface to said upper surface for facilitating finger engagement with said grip.

2. The gun gripping assembly according to claim 1, wherein said coupler is attached to said front edge of said panel.

3. The gun gripping assembly according to claim 2, wherein said coupler comprises a pivoting member configured to be pivotally coupled to the gun stock.

4. The gun gripping assembly according to claim 1, further including an attachment member being attached to said rear edge, said attachment member being configured for attachment to a shoulder strap of a gun.

5. The gun gripping assembly according to claim 1, wherein said grip is rotatably coupled to said panel to allow said second end to be extended toward said front edge in a deployed position or toward said rear edge in a stored position.

6. A gun gripping assembly configured for mounting on a gun stock, said assembly comprising:

a panel having a top side, a bottom side, a front edge, a rear edge, a first lateral edge and a second lateral edge, a coupler being attached to said panel, said coupler being configured to be attached to a gun stock;

a grip being attached to and extending downwardly from said bottom side of said panel, said grip having a first end and a second end, said first end abutting said panel, said grip being arcuate from said first end to said second end such that said grip has an upper surface being concavely arcuate and facing said bottom side and a lower surface being convexly arcuate and facing away from said panel, said second end being convexly arcuate from said lower surface to said upper surface, said second end having a plurality of indentations therein extending from said lower surface to said upper surface for facilitating finger engagement with said grip;

said coupler being attached to said front edge of said panel, said coupler comprising a pivoting member configured to be pivotally coupled to the gun stock;

an attachment member being attached to said rear edge, said attachment member being configured for attachment to a shoulder strap of a gun; and said grip being rotatably coupled to said panel to allow said second end to be extended toward said front edge in a deployed position or toward said rear edge in a stored position.

7. A gun gripping system comprising:

a gun stock having a bottom surface;

a panel having a top side, a bottom side, a front edge, a rear edge, a first lateral edge and a second lateral edge, a coupler pivotally attaching said panel to said bottom surface of said gun stock; and a grip being attached to and extending downwardly from said bottom side of said panel, said grip having a first end and a second end, said second end being a free end and said first end abutting said panel, said grip being arcuate from said first end to said second end such that said grip has an upper surface being concavely arcuate and facing said bottom side and a lower surface being convexly arcuate and facing away from said panel, said panel being between said grip and said gun stock, said grip extending downwardly away from said stock when said panel and said bottom surface are in abutment with each other and horizontally orientated.

8. The gun gripping system according to claim 7, wherein said second end has a plurality of indentations therein extending from said lower surface to said upper surface for facilitating finger engagement with said grip.

9. The gun gripping system according to claim 7, wherein said coupler is attached to said front edge of said panel.

10. The gun gripping system according to claim 9, wherein said coupler comprises a pivoting member configured to be pivotally coupled to the gun stock.

11. The gun gripping system according to claim 7, further including an attachment member being attached to said rear edge, said attachment member being configured for attachment to a shoulder strap of a gun.

12. The gun gripping system according to claim 7, wherein said grip is rotatably coupled to said panel to allow said second end to be extended toward said front edge in a deployed position or toward said rear edge in a stored position.

* * * * *